US006062033A

United States Patent [19]

Choi

[11] Patent Number: 6,062,033

[45] Date of Patent: May 16, 2000

[54] APPARATUS FOR REDUCING NOISE IN AN AIR CONDITIONER

[75] Inventor: Joong-boo Choi, Seoul, Rep. of Korea

[73] Assignee: Samsung Electronics Co., Ltd., Suwon, Japan

[21] Appl. No.: 09/148,496

[22] Filed: Sep. 4, 1998

[30] Foreign Application Priority Data

Jan. 20, 1998 [KR] Rep. of Korea ..... 98-1596

[51] Int. Cl.[7] ..... F25D 19/00

[52] U.S. Cl. ..... 62/296; 417/312

[58] Field of Search ..... 62/296; 417/312

[56] References Cited

U.S. PATENT DOCUMENTS

| | | | |
|---|---|---|---|
| 3,905,204 | 9/1975 | Edwards | 62/296 |
| 4,384,635 | 5/1983 | Lowery | 181/403 |
| 4,486,153 | 12/1984 | Romer et al. | 417/313 |
| 4,582,468 | 4/1986 | Bar | 62/296 |
| 4,991,406 | 2/1991 | Fujii et al. | 62/296 |
| 5,117,642 | 6/1992 | Nakanishi et al. | 62/296 |
| 5,125,241 | 6/1992 | Nakanishi et al. | 62/296 |
| 5,151,018 | 9/1992 | Clendenin et al. | 62/296 |
| 5,220,811 | 6/1993 | Harper et al. | 62/296 |
| 5,274,200 | 12/1993 | Das et al. | 181/202 |
| 5,339,652 | 8/1994 | Dreiman | 62/296 |
| 5,386,702 | 2/1995 | Wiesen | 62/296 |
| 5,507,151 | 4/1996 | Ring et al. | 62/296 |
| 5,669,232 | 9/1997 | Iwamoto et al. | 62/296 |

*Primary Examiner*—Henry Bennett
*Assistant Examiner*—Mark Shulman
*Attorney, Agent, or Firm*—Burns, Doane, Swecker & Mathis, L.L.P.

[57] ABSTRACT

An outdoor unit of an air conditioner includes a compressor surrounded by a noise reducing structure. The noise reducing structure includes a bottom sheet attached tightly to a lower surface of the compressor, and a dome-shaped top sheet enclosing the sides and top of the compressor. Each of the top sheet and the bottom sheet is comprised of a noise-reflecting material, and a noise-absorbing material attached to the inner side of the noise-reflecting material. The top sheet is formed of two sections joined together at a parting line lying in a vertical plane.

11 Claims, 7 Drawing Sheets

APPARATUS FOR REDUCING NOISE IN AN AIR CONDITIONER

BACKGROUND OF THE INVENTION

1. Field of the Invention

The present invention relates to a noise reducing apparatus for an air conditioner, and more particularly to a noise reducing apparatus for an outdoor unit of an air conditioner capable of reducing noise generated from a compressor during operation of the air conditioner.

2. Description of the Prior Art

Air conditioners are generally classified into an integrated type air conditioner performing both a cooling function and a heat-radiating function in one body, and a separate type air conditioner comprising indoor and outdoor units for performing the same functions respectively.

An example of an outdoor unit of the separate type air conditioner performing the heat-radiating operation is shown in FIG. 1.

As shown, the outdoor unit is provided with a front cover 10 having an opening 10*a* at a front portion thereof, a heat exchanger 12 being spaced from the front cover 10 at a predetermined distance, a fan 14 positioned between the front cover 10 and the heat exchanger 12, and a compressor 16 for compressing a low temperature and low pressure gaseous refrigerant into a high temperature and high pressurized gaseous refrigerant.

Meanwhile, reference numeral 18 denotes a partition for isolating the compressor 16 from the other components such as the fan 14 and the like.

A low temperature and low pressure gaseous refrigerant which has been evaporated in an evaporator (not shown) of an indoor unit is changed into a high temperature and high pressurized gaseous refrigerant in the compressor 16, and then condensed into a low temperature liquefied refrigerant in the heat exchanger 12. The liquid component contained in the low temperature and low pressure gaseous refrigerant is separated therefrom by an accumulator 20 installed on a suction pipe of the compressor 16.

In addition, the fan 14 fixed to the front cover 10 by a bracket 22 is rotated at a high velocity by the driving force of a fan motor (not shown). Then the air outside the outdoor unit is drawn into the outdoor unit, whereby the heat exchanger 12 is cooled. The low temperature and high pressure liquefied refrigerant which is condensed in the heat exchanger 12 loses its pressure while it passes through a capillary tube so as to be in a state apt to evaporate. Such a liquid refrigerant of which the pressure has been lowered evaporates in the evaporator, whereby the indoor air is cooled.

FIGS. 2 and 3 show a noise reducing apparatus.

The noise reducing apparatus shown in the drawings is for reducing noise generated from the compressor 16, and it consists of an upper sheet 24, a lower sheet 26, and a side sheet 28, all of which are made of noise-deadening materials.

The upper sheet 24 has first and a second holes 24*a* and 24*b* into which a suction pipe 20*a* and a discharge pipe 16*a* are respectively inserted. Also, there are cut lines 24*c* respectively extending from the first and second holes 24*a*, 24*b* to a circumference of the upper sheet 24. The first and the second holes 24*a* and 24*b* have diameters larger than those of the suction pipe 20*a* and the discharge pipe 16*a*.

The side sheet 28 is a rectangular member having such a length and width that it encloses the compressor 16 and the accumulator 20. The side sheet 22 and the upper sheet 24 are joined along a parting line lying in a horizontal plane.

Meanwhile, the lower sheet 26 has three holes 26*a* into which fixing members for fixing the compressor 16 to a bottom cover 32 are inserted.

Such upper and lower sheets 24 and 26, and side sheet 28 are formed of a noise-reflecting material 36 which reflects noise, and a noise-absorbing material 34 attached to the inner surface of the noise-reflecting material 36 for absorbing the noise. The noise reducing device constructed as above is installed as follows.

First, the lower sheet 26 is positioned on the bottom cover 32, then the fixing members are respectively inserted into the holes 26*a* of the lower sheet 26 so as to fix the compressor 16 in place. Then the discharge pipe 16*a* and the suction pipe 20*a* are welded respectively to the compressor 16 and the accumulator 20.

After that, the side sheet 28 is wrapped-round so as to enclose the compressor 16 and the accumulator 20, and then fastened by a binding means such as Velcro, or a cable tie. Each cut line 24*c* of the upper sheet 24 is then separated to make a space in order to permit the suction pipe 20*a* and the discharge pipe 16*a* to be easily inserted into the first and the second holes 24*a* and 24*b*. Lastly, the upper sheet 24 is inserted onto the side sheet 28.

Therefore, when noise radiates from the compressor 16 through the air, some of the noise is absorbed by the noise-absorbing material 34 of the upper sheet 24, the lower sheet 26, and the side sheet 28, and some of the noise which passes through the noise-absorbing material 34 is reflected into the inner space of the noise-deadening material by the noise-reflecting material 36.

Reflected noise energy repeats the above-described procedures together with the noise generated from the compressor 16, and hence it is reduced.

In the conventional art, however, since the noise reduction device requires the upper sheet 24, the lower sheet 26, and the side sheet 28 which must be assembled together, there is a shortcoming in that the productivity for manufacturing the noise reducing apparatus comprised of three sheets is low. In addition, there is another shortcoming that appreciable noise (about 54–54.2 dBA) leaks through the first and the second holes 24*a* and 24*b* and the cut lines 24*c*.

SUMMARY OF THE INVENTION

An object of the present invention is to provide a noise reducing apparatus for an outdoor unit of an air conditioner having improved productivity, which is comprised of a dome-shaped top sheet and a bottom sheet.

Another object of the present invention is to provide a noise reducing apparatus for an outdoor unit of an air conditioner, which is capable of minimizing noise radiated outside by reducing the noise leakage occurring at the upper space of the compressor.

The above objects are accomplished by an apparatus for reducing noise of an outdoor unit of an air conditioner according to the present invention, comprising a bottom sheet attached tightly to a lower surface of a compressor; and a top sheet for enclosing an upper part of the compressor, the top sheet airtightly enclosing the compressor together with the bottom sheet.

The top sheet has a shape of a dome of which a lower side is opened. The top sheet is comprised of a first sheet and a second sheet which are symmetric with each other.

Such a top sheet has a suction hole at a lower portion thereof through which a suction pipe of the compressor passes, and a discharge hole also at a lower portion thereof through which a discharge pipe of the compressor passes. In addition, the top sheet has a power supply hole at a lower portion thereof through which an electrical wire for supplying a power into the compressor passes, and a cut line cut from the power supply hole to the lower edge of the top sheet.

Each of the top sheet and the bottom plate is comprised of a noise-reflecting material which reflects noise, and a noise-absorbing material for absorbing noise and which is attached on the inner surface of the noise-reflecting material.

The bottom sheet is tightly fixed to the lower surface of the compressor and the top sheet encases the compressor and an accumulator attached to the compressor, so the apparatus for reducing the noise according to the present invention completely encloses the compressor against the outside environment.

Accordingly, since the top sheet is encased from the upper side of the compressor, the assembly efficiency is greatly improved, and the number of components to be assembled is reduced. Also the noise leakage is efficiently reduced.

BRIEF DESCRIPTION OF THE DRAWINGS

The above object and advantages will be more apparent by describing preferred embodiment in greater detail with reference to the drawings accompanied, in which.

DETAILED DESCRIPTION OF PREFERRED EMBODIMENTS OF THE INVENTION

Figure 4:
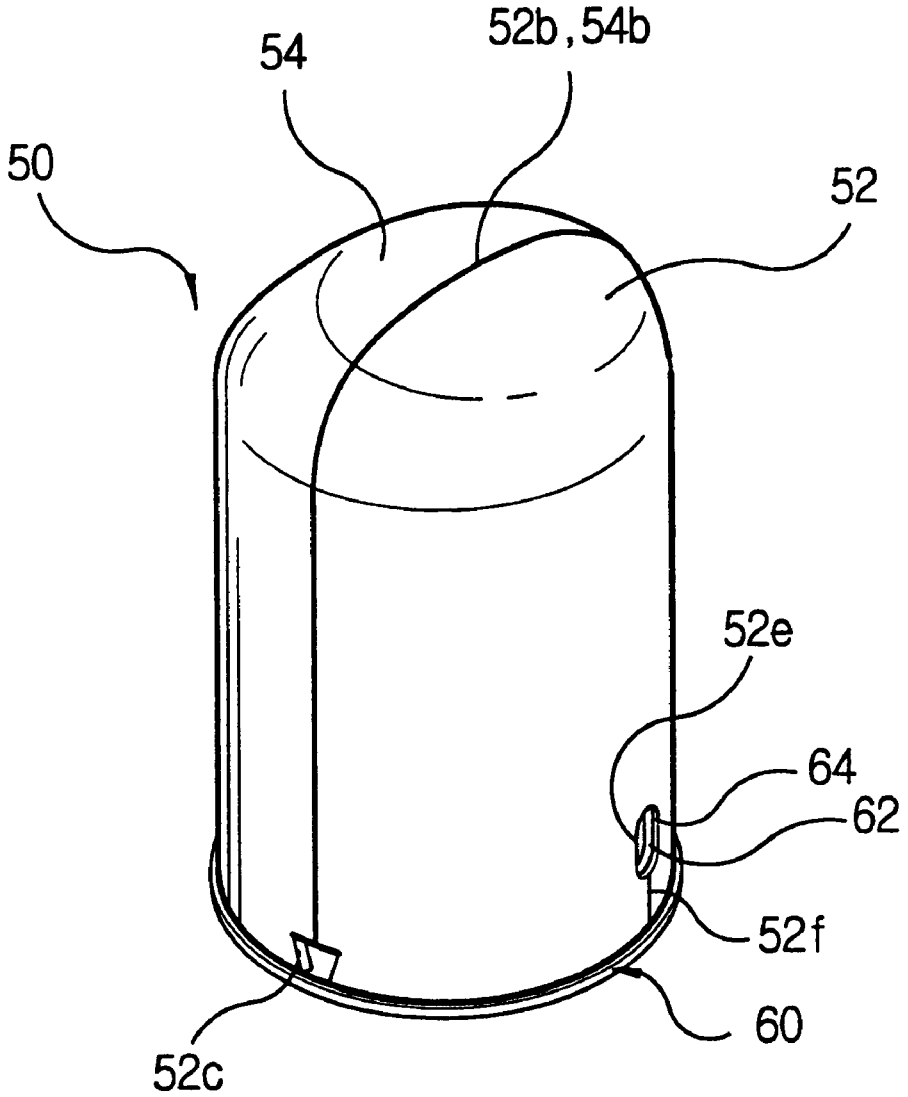
FIG. 4 is a top perspective view of a noise reducing apparatus according to a preferred embodiment of the present invention.
Figure 5A:
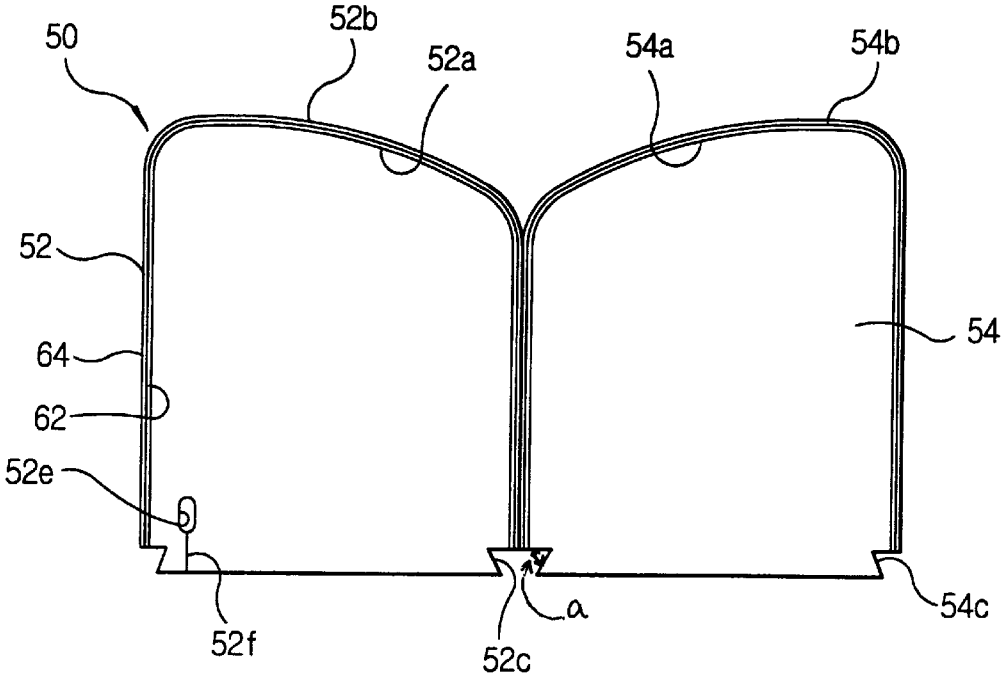
FIG. 5A is a side elevational view showing two sections of a top sheet of the noise reducing apparatus shown in FIG. 4.
Figure 5B:
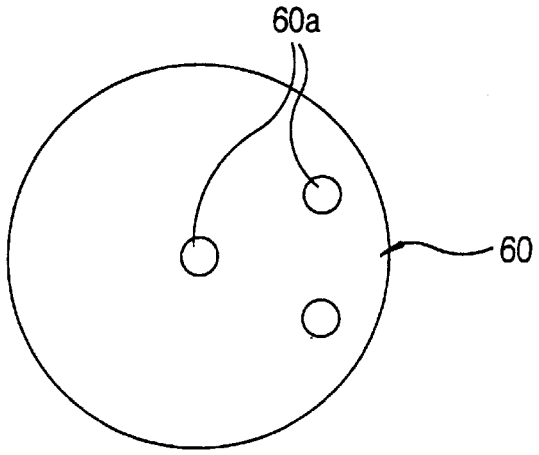
FIG. 5B is a plan view showing a bottom sheet of the noise reducing apparatus shown in FIG. 4.

FIGS. 4 through 5B show a noise reducing device according to a preferred embodiment of the present invention.

As shown, a noise reducing apparatus includes a dome-shaped top sheet 50 for enclosing upper and side portions of a compressor, and a bottom sheet 60 for enclosing a lower portion thereof. Each of the top sheet 50 and the bottom sheet 60 is comprised of a noise-absorbing material 62 which absorbs noise energy, and a noise-reflecting material 64 attached to an outer surface of the noise-absorbing material 62. The noise-reflecting material 64 reflects the noise passing through the noise-absorbing material 62. Preferably, the noise-reflecting material 64 is made of such a material that can be easily formed into a desired shape by using heat.

The top sheet 50 comprises a first semi-dome shaped sheet section 52 and a second semi-domed shaped sheet section 54 which have curved surfaces 52*a* and 54*a* at the upper sides thereof respectively.

At the lower part of the first and the second sheet sections 52 and 54, a suction hole 52*c* and a discharge hole 54*c* are provided through which a suction pipe 20*a* and a discharge pipe 16a respectively pass. The suction hole 52*c* and the discharge hole 54*c* are formed by assembling the first and second sheet sections 52 and 54, and have the same shape as one another.

Further, the suction hole 52*c* and the discharge hole 54*c* are of dovetail shape, i.e., they have an acute upper angle a. This is to reduce the noise leakage as well as to make the suction pipe 20*a* and the discharge pipe 16*a* pass therethrough easily.

Figure 6:
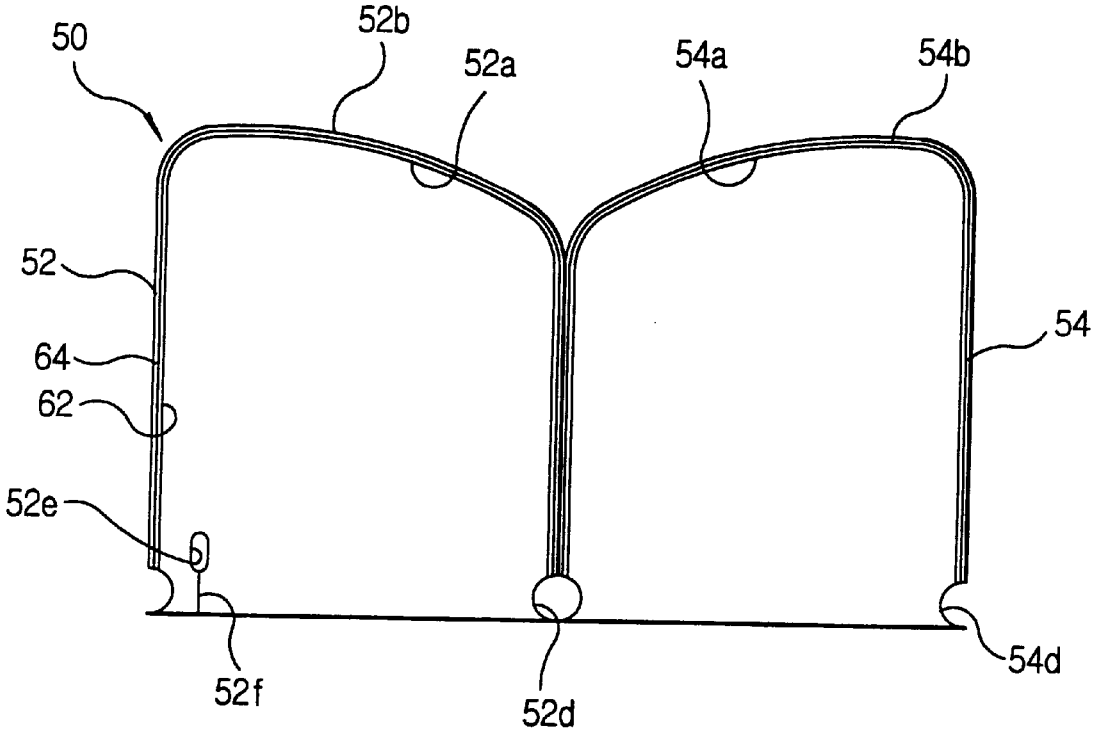
FIG. 6 is a view similar to FIG. 5A of an alternative embodiment.

Alternatively, as shown in FIG. 6, the suction hole 52*d* and the discharge hole 54*d* can have a circular shape with a diameter slightly larger than, or identical to, the suction pipe 20*a* and discharge pipe 16*a*. Accordingly, a noise leaking outside through the gap between the suction pipe 20 and the suction hole 52*d*, and the pipe 16*a* and the hole 54*d* is blocked more effectively.

In addition, the first sheet section 52 is formed with a power supply hole 52*e* at a lower side thereof through which an electrical wire (not shown) connected with the compressor 16 is inserted. From the power supply hole 52*e* to the lower edge of the first sheet section 52, a cut line 52*f* is formed so as to allow the electrical wire to pass therethrough easily. In the present embodiment, the power supply hole 52*e* is formed only in the first sheet section 52, however, it may be formed in the second sheet section 54.

The bottom sheet 60 has three holes 60*a* through which fixing members for fixing the compressor 16 to the bottom cover 32 pass. The bottom sheet 60 has a larger diameter than the top sheet 50 in order to prevent noise leakage at the bottom section.

Figure 1:
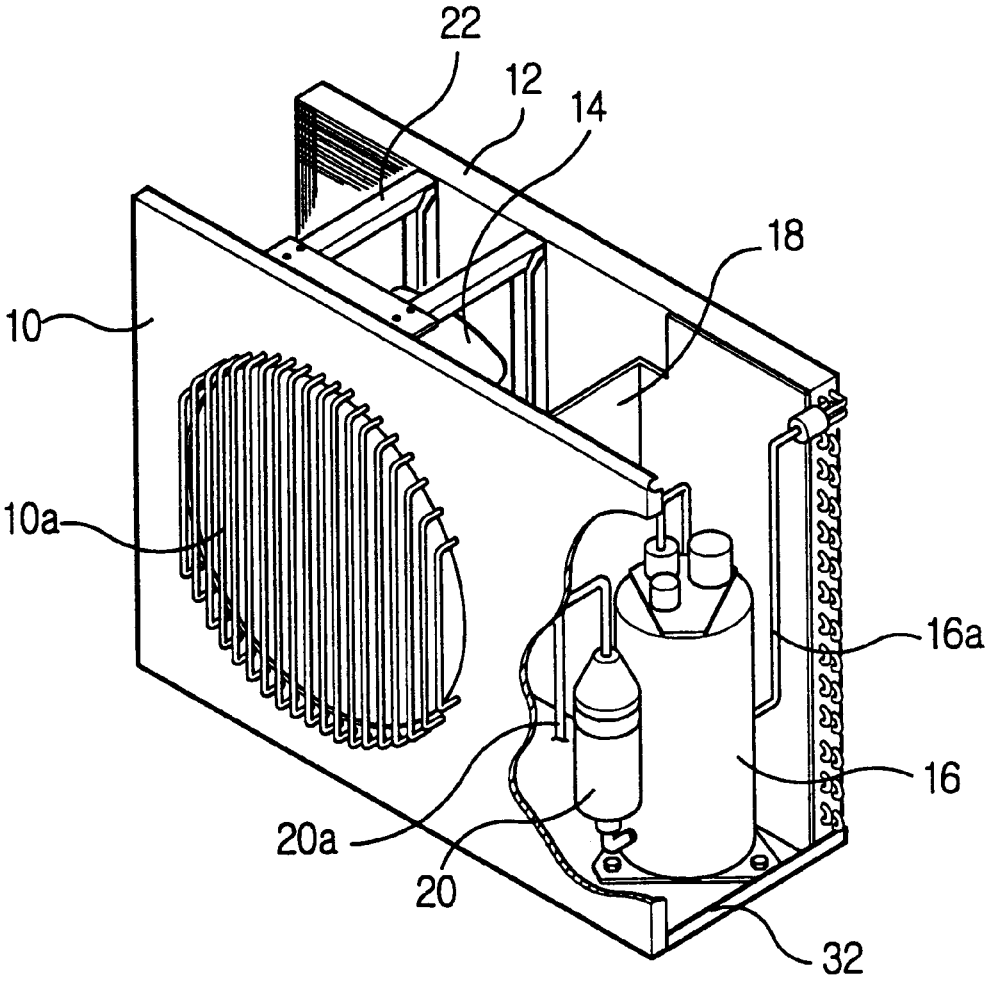
FIG. 1 (PRIOR ART)
FIG. 1 is a top perspective view showing an outdoor unit of a prior art air conditioner.
Figure 2:
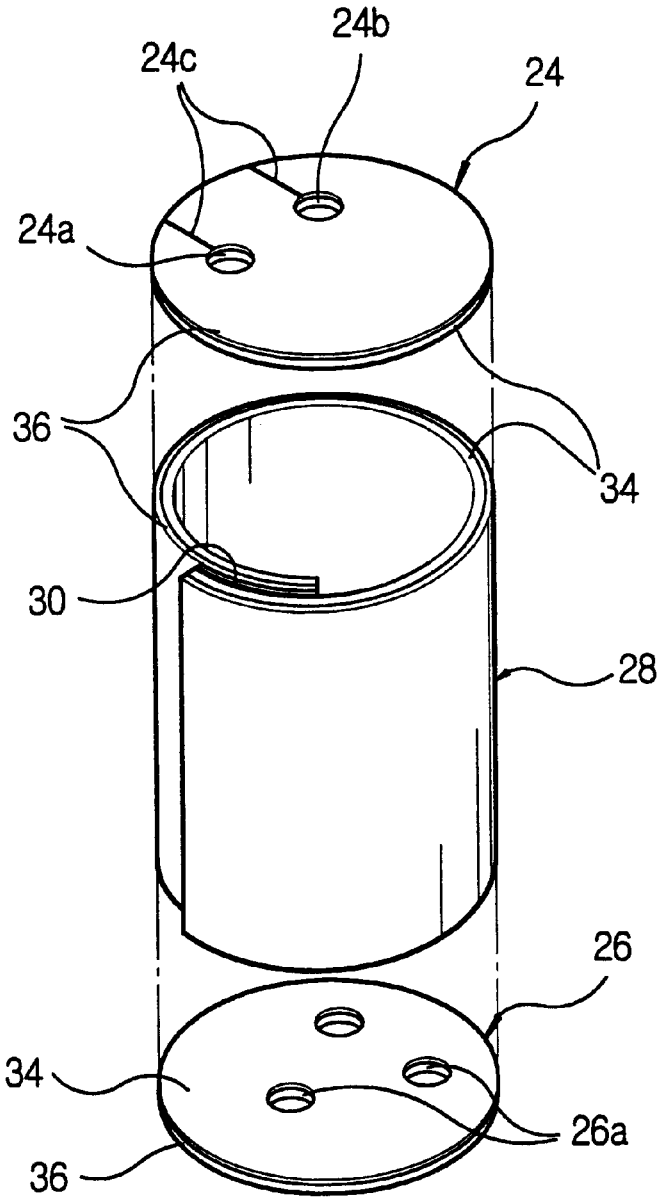
FIG. 2 (PRIOR ART)
FIG. 2 is an exploded perspective view of a conventional noise reducing apparatus.
Figure 3:
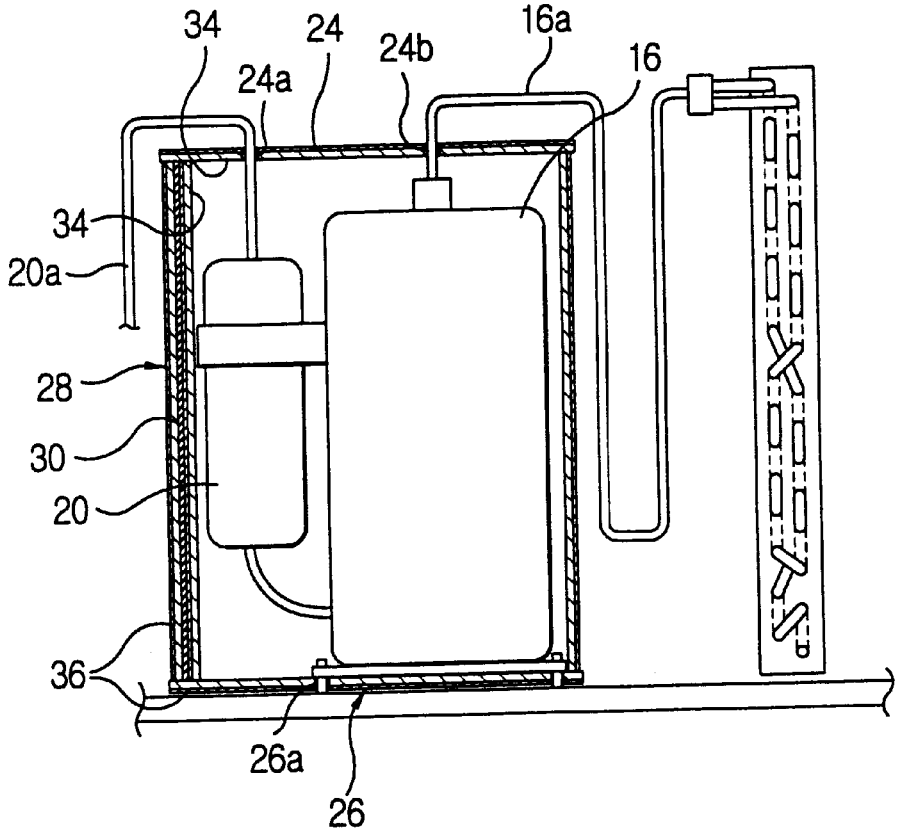
FIG. 3 (PRIOR ART)
FIG. 3 is a side view showing the conventional noise reducing apparatus employed in an outdoor unit of an air conditioner.

Moreover, when the first and second sheet sections 52 and 54 are assembled with each other, the contacting parts (i.e., the parting line) 52*b* and 54*b* of the first and the second sheet sections 52 and 54 are fastened by a binding means such as a staple, a cable tie, stitching, or the like, so as to prevent noise leakage through the contacting part. The parting line formed by the contacting parts 52*b*, 54*b* lies in a vertical plane. Thus, the upper portion of each sheet section 52, 54 extends continuously integrally with the side portion thereof, in contrast to the prior art of FIG. 2 wherein there exists a horizontal parting line between the upper portion 24 and the side portion 28. The suction hole 52*c* and the discharge hole 54*c* are situated adjacent a lower edge 50*a* of the top sheet 50. The hole 54*c* lies on the parting line as shown in FIG. 4.

Figure 7:
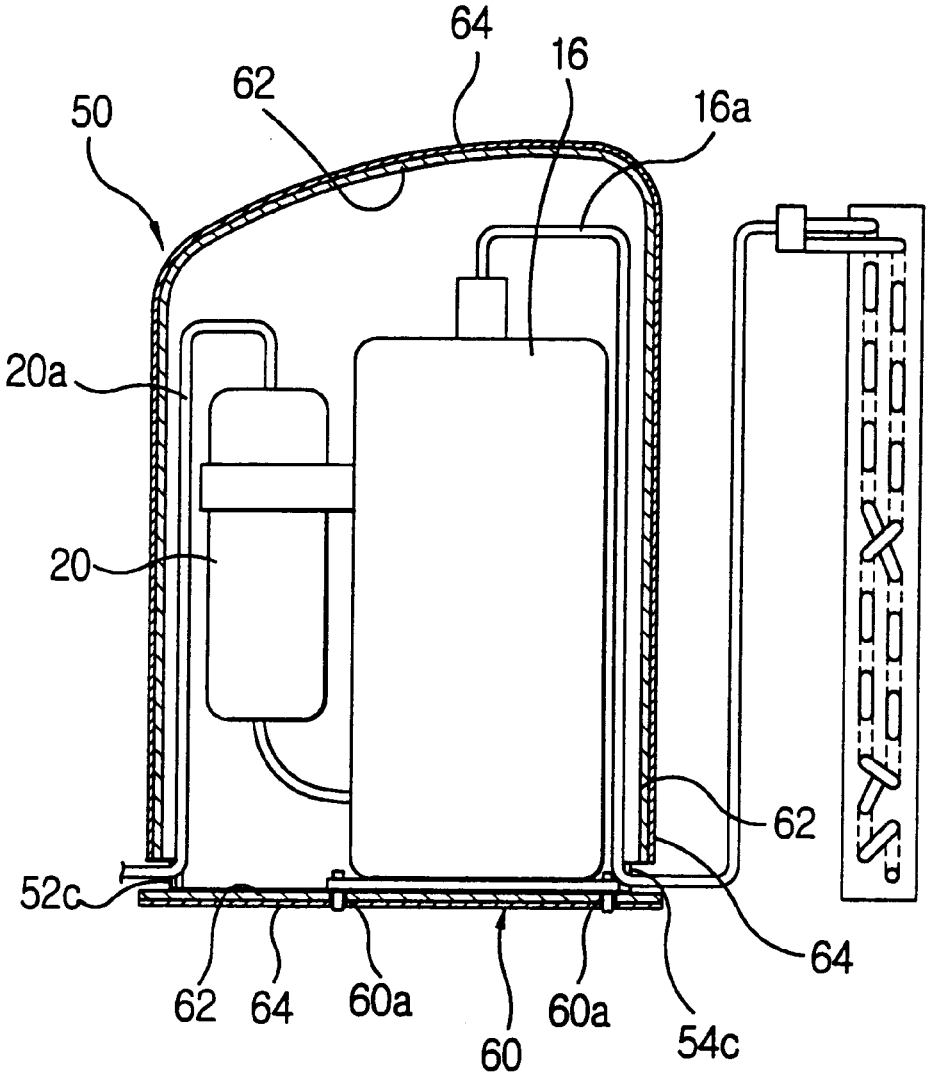
FIG. 7 is a side view of a noise reducing apparatus according to the present invention employed in an outdoor unit of an air conditioner.

Hereinbelow, the operation of the noise reducing apparatus according to the present invention having such a construction will be described in greater detail with reference to FIG. 7.

The noise-reflecting material 64 of the top sheet 50 is heated to a predetermined temperature and then formed into a dome shape by being pressed in a die so that it can enclose the compressor 16. Then, the noise-absorbing material 62 is attached to the inner surface of the noise-reflecting material 64.

After such a process, the bottom sheet 60 is positioned onto the bottom cover 32. The compressor 16 is fixed to the bottom sheet 60 by the fixing members passing through the holes 60*a*, and the suction pipe 20*a* and the discharge pipe 16*a* are respectively welded to the upper portion of the accumulator 20 and the compressor 16.

Then, the top sheet 50 is lowered in place to encase the compressor 16 together with the suction pipe 20*a* and the discharge pipe 16*a*. At this instance, the electrical wire connected to the compressor 16 is inserted into the power supply hole 52*e* through the cut line 52*f* of the first sheet 52. The cut line 52*f* is returned to its original state after the insertion of the electrical wire, and thereby noise leakage through the cut line 52*f* and power supply hole 52*e* can be blocked.

Finally, the assembling process of the noise reducing apparatus is completed by inserting the suction pipe 20*a* and the discharge pipe 16*a* into the suction hole 52*a* and the discharge hole 54*a* of the first sheet section 2 and the second sheet section 54, respectively.

During operation, some of the noise from the compressor 16 is absorbed by the noise-absorbing material 62 of the top sheet 50 and bottom sheet 60, and some of the noise is reflected by the noise-reflecting material 64.

The reflected noise is repeatedly absorbed by the noise-absorbing material 62 and re-reflected by the noise-reflecting material 64 along with the noise just radiated from the compressor 16. Gradually, the noise remaining in the inner space of the top sheet 50 is reduced as it repeats the above process. In addition, since the noise radiated from the compressor 16 only leaks through the gap between the top sheet 50 and the bottom sheet 60, the noise leaking outside can be minimized to 50.0~52.2 dBA.

According to the noise reducing apparatus of the outdoor unit of the air conditioner as described above, since the upper and lower portions of the sheet 50 are integrated, the efficiency of the assembling process is enhanced and noise leakage is blocked more effectively, whereby audible noise is minimized.

While the present invention has been particularly shown and described with reference to the preferred embodiment thereof, it will be understood by those skilled in the art that various changes in form and details may be effected therein without departing from the spirit and scope of the invention as defined-by the appended claims.

What is claimed is:

1. An outdoor unit of an air conditioner, comprising:

a compressor; and a noise-reducing apparatus encompassing the compressor and including a bottom sheet attached tightly to an underside of the compressor, and a top sheet disposed atop the bottom sheet and encompassing upright sides and a top of the compressor, the top sheet comprising a downwardly-open dome-shaped structure having a lower edge attached to a top surface of the bottom sheet, the dome-shaped structure including first and second substantially identically shaped semi-dome shaped sections joined together along a parting line lying in a substantially vertical plane, the dome-shaped structure covering top and side portions of the compressor and including a suction hole and a discharge hole formed therein adjacent the lower edge thereof and adapted to accommodate a suction pipe and a discharge pipe, respectively, of the compressor.

2. The outdoor unit according to claim 1, wherein the first and second sheet sections are stapled together.

3. The outdoor unit according to claim 1, wherein the first and second sheet sections are tied together.

4. The outdoor unit according to claim 1, wherein the first and second sheet sections are stitched together.

5. The outdoor unit according to claim 1, wherein each of the suction hole and the discharge hole is of dovetail shape.

6. The outdoor unit according to claim 1, wherein each of the suction hole and the discharge hole has a circular shape.

7. The outdoor unit according to claim 6, wherein the suction hole and the discharge hole have identical diameters, the diameters coinciding with respective diameters of the suction pipe and the discharge pipe.

8. The outdoor unit according to claim 1, wherein the top sheet has a power supply hole at a lower portion thereof through which an electrical wire for supplying a power to said compressor passes, and a cut line cut from the power supply hole to a lower end of the top sheet to enable the electrical wire to be inserted into the power supply hole.

9. The outdoor unit according to claim 1, wherein each of the top sheet and the bottom sheet includes a noise-reflecting material for reflecting noise, and a noise-absorbing material attached to an inner surface of the noise-reflecting material for absorbing noise.

10. The outer door unit according to claim 1 wherein the suction and discharge holes intersect the lower edge.

11. The outdoor unit according to claim 1 wherein one of the holes lies on the parting line.

* * * * *